US005084608A

United States Patent [19]

Logan

[11] Patent Number: 5,084,608

[45] Date of Patent: Jan. 28, 1992

[54] RETRACTABLE BURNER FOR AN ELECTRIC RANGE

[76] Inventor: Eugene T. Logan, 449 Queens Rd., Salina, Kans. 67401

[21] Appl. No.: 641,461

[22] Filed: Jan. 15, 1991

[51] Int. Cl.[5] ..... H05B 3/76

[52] U.S. Cl. ..... 219/459; 219/444; 219/456

[58] Field of Search ..... 219/459, 444, 467, 451, 219/463, 457, 464, 456

[56] References Cited

U.S. PATENT DOCUMENTS

| | | | |
|---|---|---|---|
| 1,399,696 | 12/1921 | De Roo . | |
| 1,825,406 | 9/1931 | Lipham . | |
| 2,528,579 | 11/1950 | Clark | 219/35 |
| 2,635,172 | 4/1953 | Rutenber | 219/37 |
| 2,664,495 | 12/1953 | Wehrli | 219/43 |
| 2,761,053 | 8/1956 | Schneider | 219/37 |
| 2,825,790 | 3/1958 | Sims | 219/37 |
| 3,440,406 | 4/1969 | Sego | 219/444 |
| 3,578,951 | 5/1971 | Ingrado | 219/444 |
| 3,700,856 | 10/1972 | Kullman | 219/451 |
| 3,898,430 | 8/1975 | Sego | 219/444 |
| 4,206,341 | 6/1980 | Leuschner | 219/283 |

*Primary Examiner*—Teresa J. Walberg
*Attorney, Agent, or Firm*—Head & Johnson

[57] ABSTRACT

A device for raising and dropping the burner element in an electric range wherein cookware is supported upon a plurality of rigid posts and the burner element is raised and dropped in a plane parallel to the plane comprised by the bottom surface of the cookware. This allows the user to obtain radiant heat transfer for more even cooking. In addition, it allows the cookware to cool much more quickly without removing it from the range than traditional electric ranges where the cookware rests directly upon the burner element.

7 Claims, 5 Drawing Sheets

RETRACTABLE BURNER FOR AN ELECTRIC RANGE

BACKGROUND OF THE INVENTION

1. Field of the Invention

This invention relates to a apparatus for use in an electric range.

2. Description of the Related Art

The disadvantage of cooking with a traditional electric range is that the cookware rests directly upon the burner element. As a result the coil-type element itself must include a relative thick metal sheath of thickness and strength to support the cookware without deforming the element. In this type of range, the heat source cools much slower than other types, such as gas. The electric burner element transfers heat to the cookware in the electric range, while it is the flame produced by the burning of the natural gas or propane that transfers heat in the gas range. When the electric burner is turned off, heat is still transferred to the cookware because the hot burner element and the cookware are in direct contact. This heat transfer continues until the burner element cools to room temperature. When the gas range is turned off or with less flame, the gas flow ceases and the flame is extinguished. The heat transfer ceases at the point of shut-off and the cookware begins to cool immediately. If the desired result is to lower the intensity of the heat transfer, the user of the electric range has to take into account time required for the burner element to cool to the new temperature setting. With the gas range, decreasing the gas flow lowers the intensity of the flame thereby decreasing the heat transferred immediately. The ability to rapidly vary the amount of heat transferred has been the major advantage of gas ranges over electric. The present invention gives the electric range this same versatility.

DISCLOSURE STATEMENT

The following U.S. Patents are believed pertinent

| | | |
|---|---|---|
| 1,399,696 | 12/06/1921 | C. P. De Roo |
| 1,825,406 | 09/29/1931 | Lipham |
| 2,528,579 | 11/07/1950 | E. K. Clark |
| 2,635,172 | 04/14/1953 | E. A. Rutenber |
| 2,664,495 | 12/29/1953 | A. Wehrli |
| 2,761,053 | 08/28/1956 | F. H. Schneider |
| 2,825,790 | 03/04/1958 | R. J. Sims |
| 4,206,341 | 06/03/1980 | Leuschner et al. |

Many of these patents were directed to deep well devices wherein the lower heating element could move up or down but would always maintain contact with the cookware. This is the case in the patents of Wehrli, Lipman, and Schneider.

The patents of Sims, Rutenber, and Clark relate to devices in which the heating element can be moved from a lower position to an upper position for use either as a respective deep well cooker or a regular top heating element. However, the cookware maintains constant direct contact with the heating element in these devices also.

The De Roo patent discloses an electric heater device used in an apparatus for determining the amount of moisture in a product which heats a receptacle containing the product to be tested. The electric heater device is immediately released and automatically moved away from the receptacle when the heat rises above a predetermined degree, thus ceasing heat transfer.

The Leuschner et al patent discloses a warming plate wherein the heating element can be pivoted about a point such that the element makes an arcuate motion about a fixed point up to and away from the surface of the warming plate.

SUMMARY OF THE INVENTION

This invention relates to an apparatus for an electric range which allows the user to raise and lower the burner element independently of the cookware that is being heated by that burner element. In this invention, the cookware rests on top of a plurality of support posts instead of the burner element itself. The support posts are fixed to the range and stay at a fixed level while the burner element can be raised and lowered with respect to the top of the support posts. In the preferred embodiment, a control knob is connected to a series of actuating arms which operate to raise and lower a spring tensioned spool. Support means for the burner element is fixed to this spool; thus, the burner element is raised and lowered in a plane parallel to the plane of the bottom surface of the cookware by the raising and lowering of the spool. Various combinations of heating modes can be obtained because the burner element can be in the raised or lowered position at any heat setting. When in the lower position, it provides gentle heat (radiant only) while in the raised position it provides the traditional direct heating.

The present invention can be used with the traditional electric range to provide substantially the same effect as the rapid cooling characteristic of a gas range. Uniformly supporting the cookware above a lowered electric burner element in a parallel plane reduces heat transfer to the bottom surface of the cookware. While in such position, the heat element provides gentle heat (radiant) which is useful for simmering foods such as puddings, sauces, gravies, or soups. Any combination of heating modes can be obtained where the burner element can be raised or lowered at any heat setting.

The object of the invention is to maintain consistent, uniform heating of the cookware while being able to remove the electric burner element from direct contact with the cookware.

A further object of the invention results in an electric heating element having a thinner metal sheath than that of the prior art since it isn't necessary for the element to support the cookware.

DETAILED DESCRIPTION OF THE PREFERRED EMBODIMENTS

Figure 1:
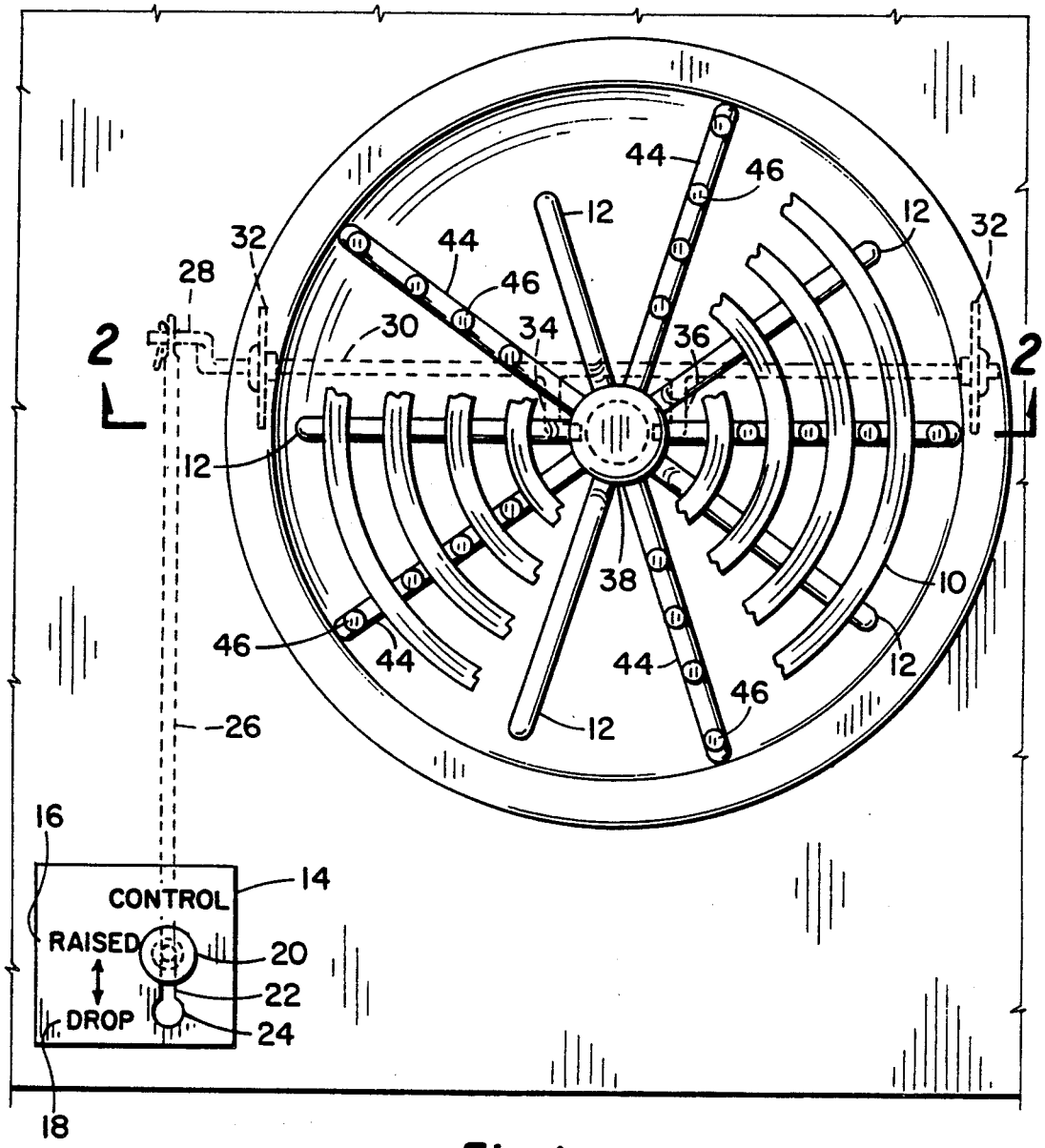
FIG. 1 is top elevated view of the elements of the invention.
Figure 2:
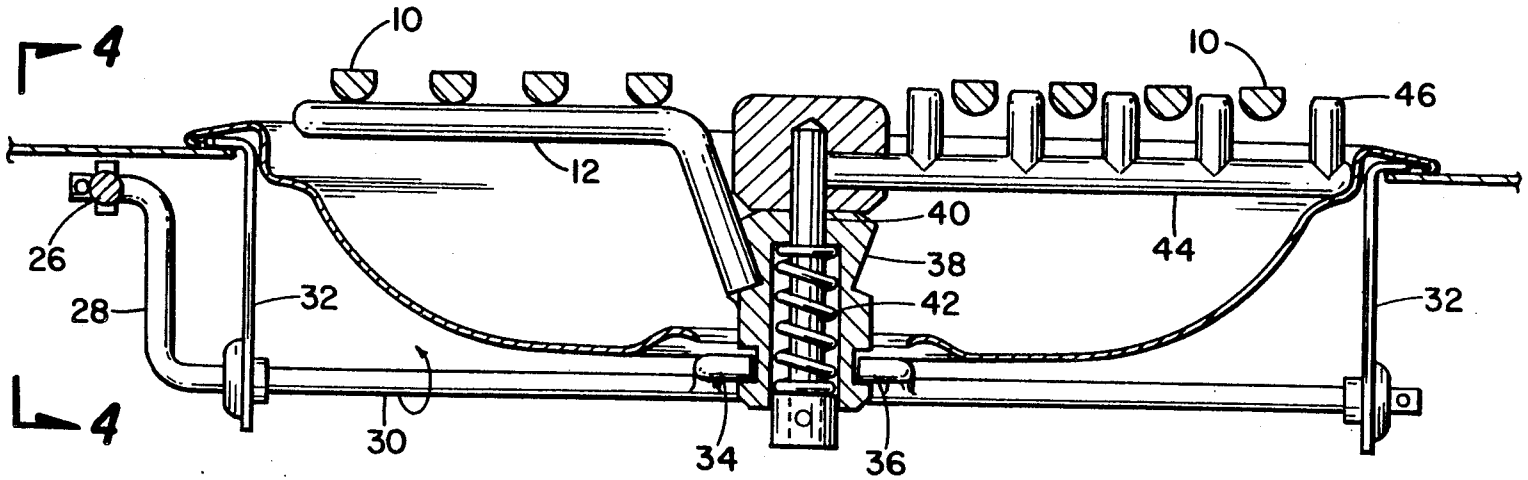
FIG. 2 is view taken along line 2—2 of FIG. 1 showing the burner element in the raised position.
Figure 3:
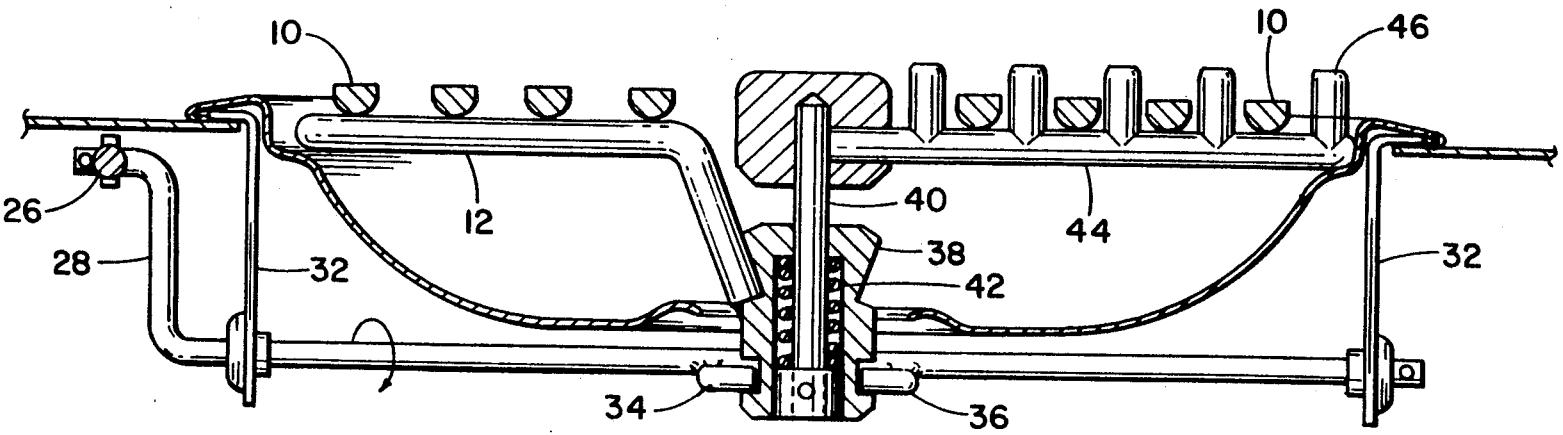
FIG. 3 is a view taken along line 2—2 of FIG. 1 showing the burner element in the lowered position.

Reference is first made to FIG. 1 which shows a control panel 14 having two settings, a raised setting 16 and a lower or drop setting 18. The user can position a knob 20 to the raised position 16 by sliding it forward in channel opening 22, or sliding it back and securely engaging it into keyhole-like opening 24 of control panel 14 for the drop position. As shown in FIG. 2, knob 20 is in the raised position with burner 10 at the level of the top of support posts 46. As shown in FIG. 3, when knob 20 is in the drop position, the burner element 10 is well below the top of posts 46.

Referring back to FIG. 1, a first actuating arm 26 is connected at one end to knob 20 and pivotally connected to a second actuating arm 28 at its other end. Arm 28 is composed of three segments, a long middle section and two shorter segments which are at right angles to the long section. One of the shorter segments is connected to the first actuating arm 26 and the other is connected to rod 30. The second actuating arm 28 is rigidly attached to rod 30 which extends underneath the burner element 10. Rod 30 is secured to the range on opposite sides of burner element 10 by two supports, each labeled 32, in which rod 30 is free to rotate. A third actuating arm 34 and a fourth actuating arm 36 extend at 90 degrees to rod 30 and are rigidly attached to it. Actuating arms 34 and 36 are pivotally connected to spool 38 at points 180 degrees spaced around the circumference of spool 38.

As shown in FIG. 1, burner element 10 is comprised of a single coiled burner element 10 such that a space exists between each coil. Burner element 10 is flexibly connected to a suitable electrical power source by way of a removable plug as is known in the art. This element rests upon five radial support arms, each labeled 12. Each support arm 12 is rigidly connected to hollow spool 38. As spool 38 is raised and dropped by the action of knob 20, actuating arms 26, 28, 34, 36, and rod 30, burner support arms 12 are raised and dropped. Since burner support element 10 rests upon burner support arms 12, burner element 10 is correspondingly raised and dropped.

Figure 4:
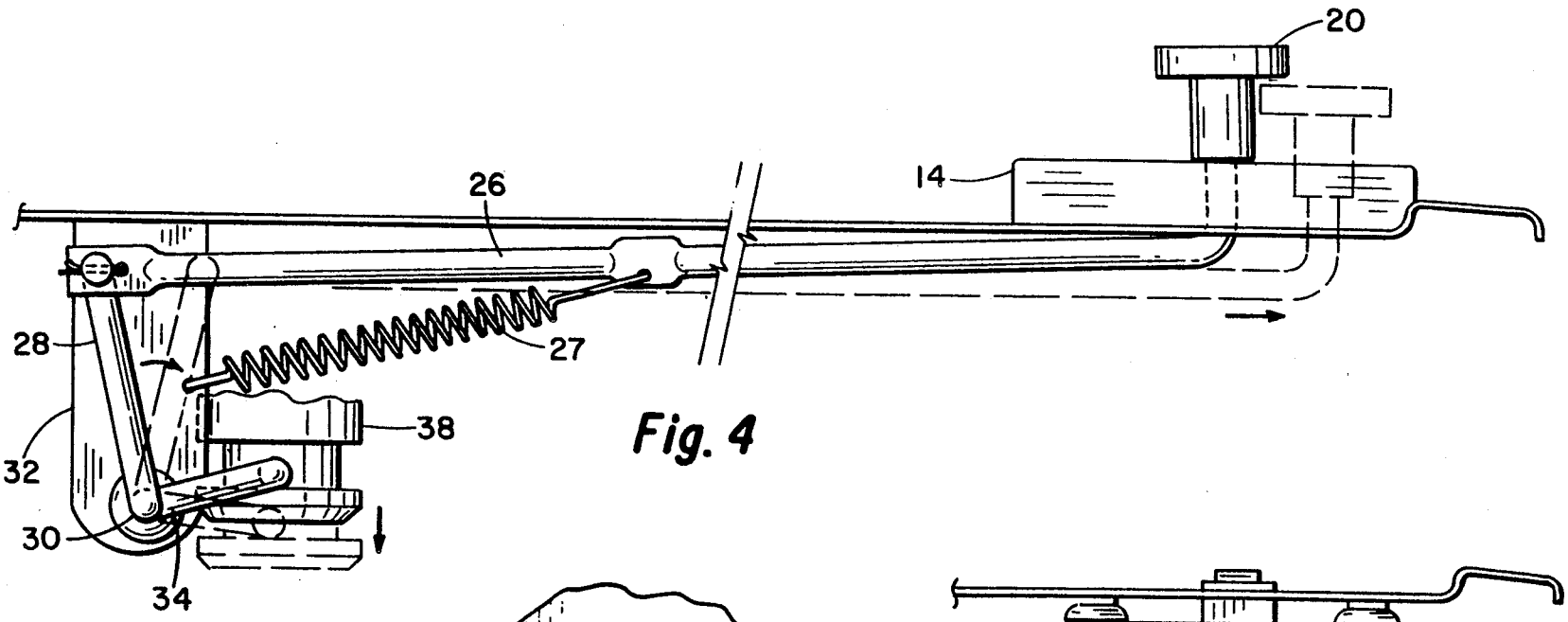
FIG. 4 is a partial elevational view taken along line 4—4 of FIG. 2.

FIG. 4, which is a view along the length of rod 30 of FIG. 1, depicts, by dashed lines, the movement of knob 20, the first actuating arm 26, the second actuating arm 28, spring 27, the third actuating arm 34, and spool 38. As knob 20 is moved to engagement in control panel 14, the first actuating arm 26 moves in the same direction. When the first and second actuating arms move to the drop position, depicted by the dashed lines, spring 27 is extended. Engaging Knob 20 into control panel 14 holds the mechanism in the drop position. The second actuating arm 28 rotates rod 30 in the direction of movement of the first actuating arm as shown by the arrow. As rod 30 rotates, the third actuating arm 34, and the fourth 36 (as shown in FIG. 2), pivot down, thus pushing down spool 38, to which it is pivotally connected thus lowering the burner element. On the other hand, when control knob 20 is released from engagement with control panel 14, rod 30 and actuating arms 28, 34, and 36 rotate in a reverse manner as shown by the arrow to lift spool 38 to the raised position thus raising the burner element.

FIG. 2 is a view taken along line 2—2 of FIG. 1 depicting the device in the raised position. A vertical member 40, which is supported from the electric range, extends through hollow spool 38 to support post 46 for supporting cookware, as will be explained hereinafter. A spring 42 is coiled around vertical member 40 and held inside spool 38. When burner element 10 is in the raised position, spring 42 exerts pressure forcing spool 38 to its highest point. When spool 38 is at its highest point, so are burner support arms 12 and burner element 10.

FIG. 3 depicts the device in the drop or lower position. When in the drop position, spring 42 is compressed and spool 38, burner support arms 12, and burner element 10 are all in their lower position. When control knob 20 is disengaged from control panel 14, the force exerted by spring, 42 of FIG. 3, pushes spool 38 to the raised position, thus raising burner element 10. The mechanism is held in the drop position and released when control knob 20 is disengaged.

Spring 42 of FIGS. 2 and 3, and spring 27 of FIG. 4 perform the same function, to maintain tension on the apparatus when in the drop position and to return the apparatus to the raised position when knob 20 is disengaged from control panel 14. That is, in this embodiment the burner element is normally biased to the raised position. Three possible embodiments would be to employ spring 42 of FIGS. 2 and 3 alone, employ spring 27 of FIG. 4 alone, or employ both.

As depicted in FIG. 1, there are five horizontal members 44 rigidly connected to one end of vertical member 40 which is supported by the electric range on the other. Referring now to FIGS. 2 and 3, each horizontal member 44 contains a plurality, e.g. five vertical posts, collectively numbered 46, which extend through the spaces between the coils of burner element 10. Any suitable number of posts may be used. Vertical member 40, horizontal members 44, and support posts 46 remain in a fixed position. Cookware is placed directly upon and rests upon vertical posts 46. Burner element 10 is raised and dropped in a plane parallel to the plane defined by the bottom surface of the cookware resting on posts 46. The manner in which horizontal members 44, containing posts 46 thereon which extend through the spaces between the coils of burner element 10, can be seen further in FIG. 1.

Figure 6:
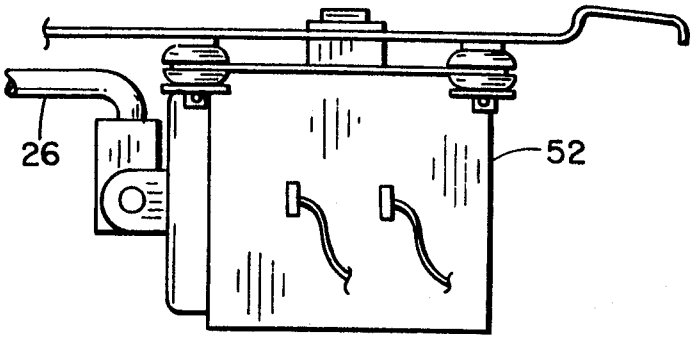
FIG. 6 is a partial elevational view showing an alternate embodiment of the invention in the drop position.
Figure 5:
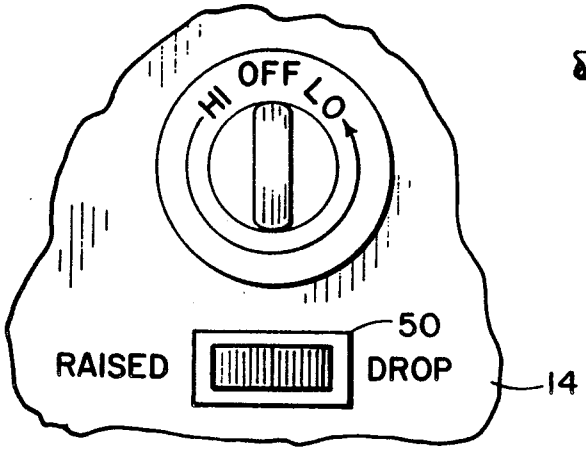
FIG. 5 is a partial elevational view showing an alternate embodiment of the invention.
Figure 7:
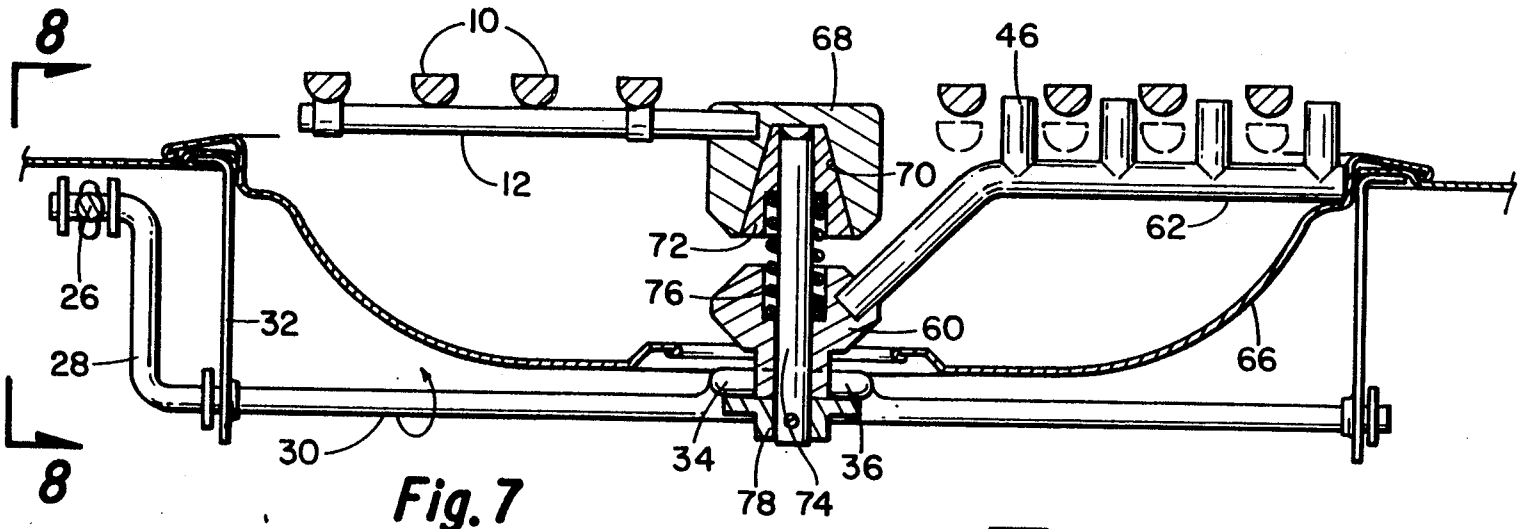
FIG. 7 is a side sectional view similar to FIG. 2 of an alternate embodiment of the invention.
Figure 8:
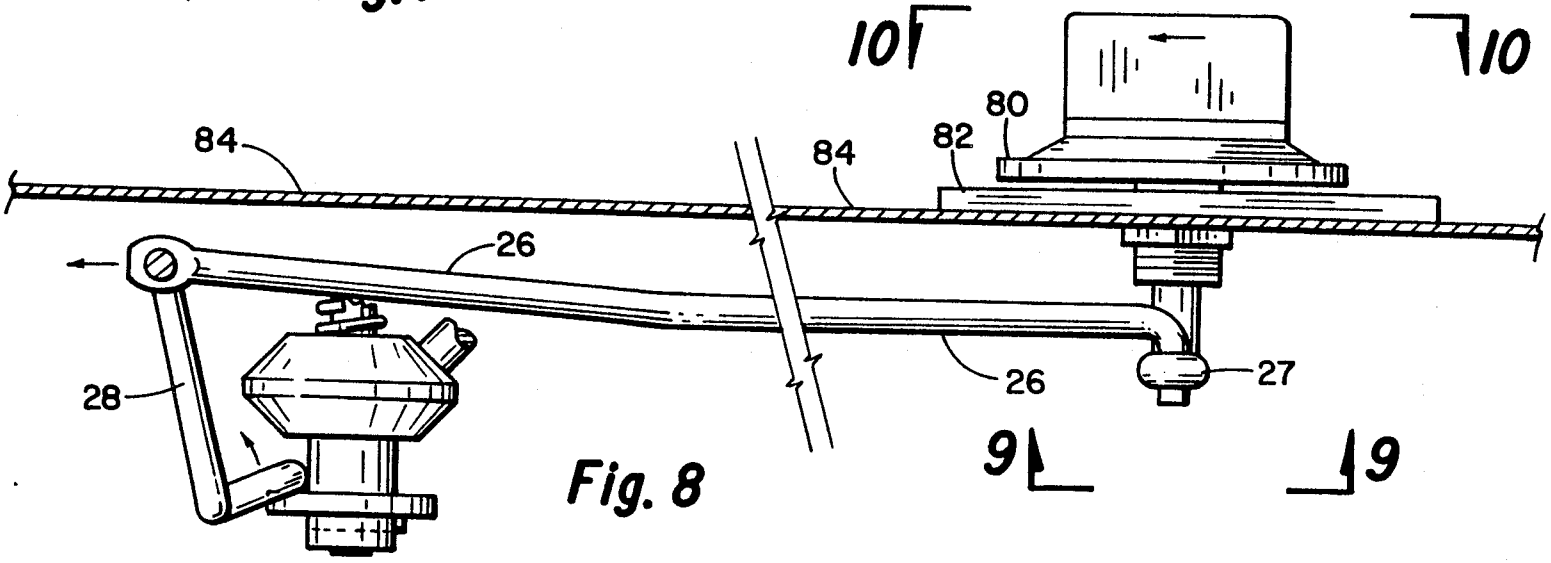
FIG. 8 is a partial sectional view taken along the line 8—8 of FIG. 7.

In an alternate embodiment, a solenoid 52, as shown in FIG. 6, can be employed as the means to move the first actuating arm and operate the device. Knob 20, of FIG. 4, is omitted and the first actuating arm 26 is pivotally connected to an electric solenoid 52. Also in that embodiment, knob 20, channel 22, and opening 24, of FIG. 1, are replaced, as shown on FIG. 5, on control panel 14 by switch 50 containing a "raised" and a "drop" position which operates solenoid 52. When the switch 50 is turned by the user from the raised position to the drop position, solenoid 52 is electrically activated so as to move the first actuating arm 26, which pivots the second actuating arm, rotating rod 30 that, in turn, lowers the third 34 and fourth 36 actuating arms which pivot spool 38 downward, thereby lowering the burner element support arms 12 on which burner element 10 rests, thereby lowering burner element 10. When switch 50 is placed in the "raised" position, the solenoid operates through the various connecting means to raise the burner element 10 to the position shown in FIG. 2. This alternate embodiment operates in substantially the same way as the preferred embodiment except with less effort on the part of the user.

Figure 11:
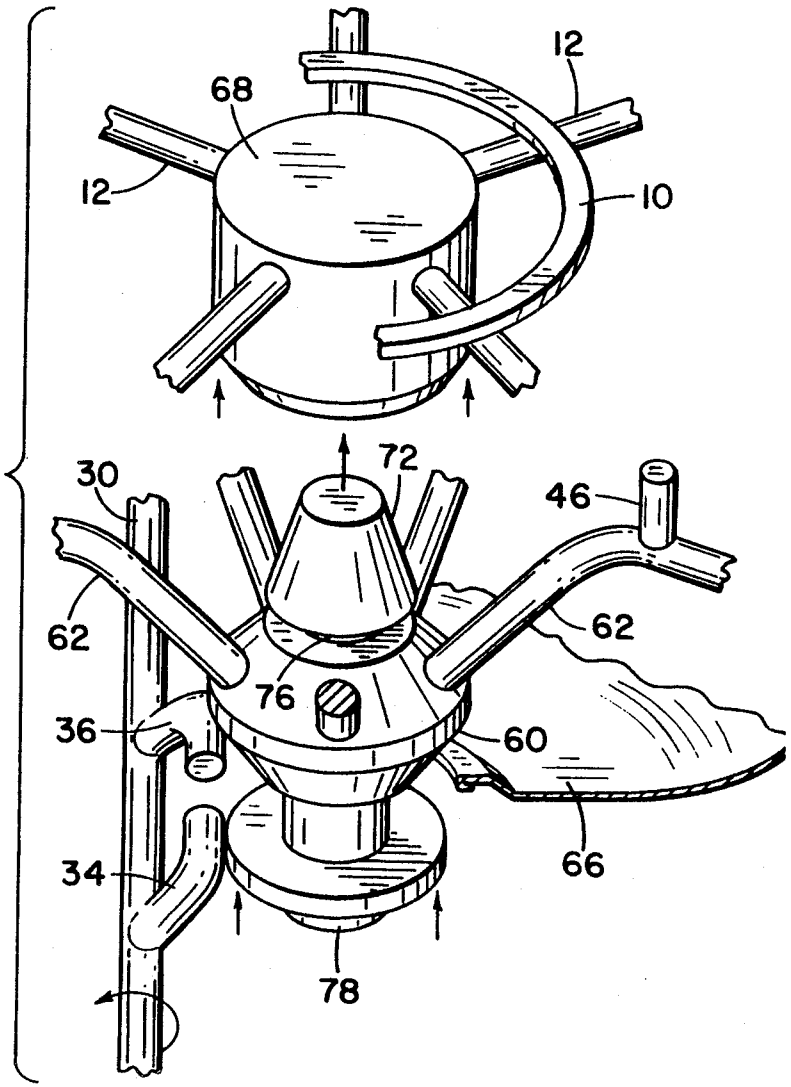
FIG. 11 is an exploded view depicting the removable disassembly of the burner parts of this invention.
Figure 9:
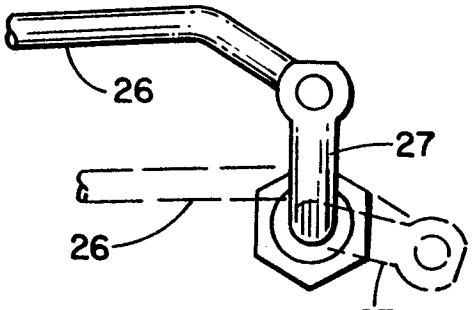
FIG. 9 is a view taken along the line 9—9 of FIG. 8.
Figure 10:
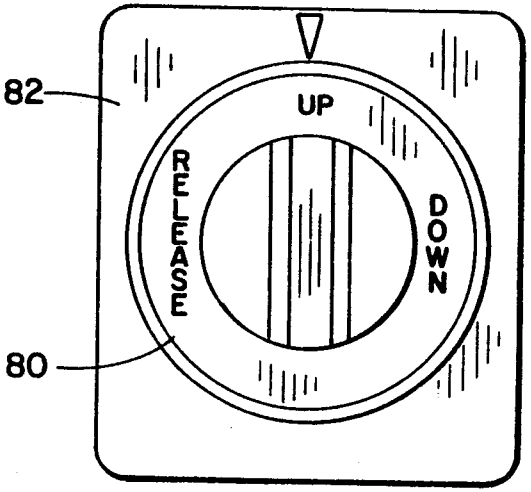
FIG. 10 is a front view of the control knob taken along the line 10—10 of FIG. 8.

FIGS. 7–11 depict an alternate embodiment which is particularly adapted to permit the disassembly and cleaning of a burner element. Like numbers from previous drawings represent like parts. In this embodiment spool 60 supports the horizontal members 62 which have the cookware support posts 64, similarly described heretofore. Below the burner assembly is a typical reflector bowl 66. The coil type burner element 10 is supported upon a plurality of radial arms 12 which are attached to the central hub 68. The central hub 68 includes a conical seat 70 which receives the cone 72 formed as a part of the assembly comprising post 74, spring 76, spool 60 and follower or keeper 78. Disassembly of the burner occurs by first turning knob 80 to the "release" position as shown by the arrow. As shown in FIG. 11 this causes actuating arms 34 and 36 to move upward. Next, the assembly of the burner elements 10, radial arms 12 and the attached hub 68 are removed while simultaneously unplugging the burner element from its electrical connection. Then, the interconnected assembly of the cone 72, post 74, spring 76, spool 60, and follower 78 can be removed. The reflector bowl 66 is then removed for cleaning and reassembly.

In a typical use of the invention, the cookware and its contents are placed on the burner. Arms 12 and attached elements 10 are raised to a position in direct connection contact with the bottom of the cookware. The contents, if a liquid, are then heated to a rolling boil. The arms 12 and elements 10 are then lowered as the amount of heat to the burner element 10 is reduced providing radiant heat. Substantially instantaneously the contents begin to simmer.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled. For example, although the invention has been described as showing a raised and lower or drop position, it is within the scope of the invention to include means to achieve burner positions therebetween.

One modification of the invention is to incorporate means of raising and lowering of the burner element with the burner heat control. That is when the element is lowered so is the amount of heat provided by the burner element.

What is claimed is:

1. A surface heating unit for an electric range comprising:

a reflective bowl with a central bottom opening above which is situated an electrical heating element arranged in a horizontal circular or helically arranged pattern;

means to removably connect said heating element to an electrical connection means through said reflective bowl;

a plurality of radial arms connected to a central hub, said heating element connected to a top side of said radial arms;

a spool assembly co-axially positioned below said central hub;

a plurality of horizontal members radially attached to said spool assembly, said horizontal members normally resting upon a peripheral edge of said reflector bowl, a plurality of vertical cookware support posts attached to and extending above said horizontal members between said heating element;

means to bias said central hub axially such that a top of said heating element is normally in a raised horizontal position above said vertical cookware support posts, said means comprising a coaxial compression spring between said central hub and said spool assembly;

a coaxial vertical member extending upward through said central bottom opening of said reflective bowl, thence through said spool assembly and said spring to a removable connection with said central hub; and a follower means attached to said vertical member below said spool assembly;

an actuating arm and cam means to releasably interconnect with said follower means;

means to rotate said actuating arm and cam means downward to cause said heating element to move axially downward to a lower horizontal position below a top of said vertical cookware support posts and to rotate said cam means upward from contact with said follower means such that when said heating element is removed and attached radial arms are removed, said spool assembly and said reflector bowl can be removed from the said electric range.

2. The unit of claim 1 wherein said removable connection comprises an interior conical surface in said central hub which is removably situated upon a matching exterior conical surface connected to said co-axial vertical member.

3. The unit of claim 1 wherein said electric range includes a control panel and said means to rotate comprises a control knob attached to a first end of said actuating arm, said control knob extending through said control panel with means to move said knob between said raised position and said lower position.

4. The unit of claim 1 wherein said electric range includes a control panel, and said means to rotate comprises an electric solenoid means controlled by a control knob situated at said control panel.

5. A surface heating unit for an electric range comprising:

a reflective bowl with a central bottom opening above which is situated an electrical heating element arranged in a horizontal circular or helically arranged pattern;

means to removably connect said heating element to an electrical connection means through said reflective bowl;

a plurality of horizontal members radially attached to a central hub, said horizontal members normally resting upon a peripheral edge of said reflector bowl, a plurality of vertical cookware support posts attached to and extending above said horizontal members between said heating element;

a spool assembly co-axially positioned below said central hub;

a plurality of radial arms connected to said spool assembly, said heating element resting on a top side of said radial arms;

a vertical member extending upward and coaxial with said central bottom opening of said reflective bowl, thence through said spool assembly and through a spring means to a fixed connection with said central hub;

said spring means to normally bias said spool assembly axially such that said heating element is in a raised horizontal position above said vertical cookware support posts;

a follower means attached to said spool assembly;

an actuating arm and cam means to releasably interconnect with said follower means; and means to rotate said actuating arm and cam means downward to cause said heating element to move axially downward to a lower horizontal position below a top of said vertical cookware support posts and to rotate said cam means upward from contact with said follower means such that when said heating element is removed, said spool assembly and said reflector bowl can be removed from the said electric range.

6. The unit of claim 5 wherein said electric range includes a control panel and said means to isolate comprises a control knob attached to a first end of said actuating arm, said control knob extending through said control panel with means to move said knob between said raised position and said lower position.

7. The unit of claim 5 wherein said electric range includes a control panel, and said means to rotate comprises an electric solenoid means controlled by a control knob situated at said control panel.

* * * * *